United States Patent [19]

Fluck

[11] 4,451,160

[45] May 29, 1984

[54] WATCH WITH A PUSH BUTTON

[75] Inventor: Josef Fluck, Granges, Switzerland

[73] Assignee: ETA S.A. Fabriques d'Ebauches, Switzerland

[21] Appl. No.: 305,090

[22] Filed: Sep. 24, 1981

[30] Foreign Application Priority Data

Oct. 10, 1980 [CH] Switzerland ..... 7567/80

[51] Int. Cl.[3] ..... G04B 37/00

[52] U.S. Cl. ..... 368/290; 200/159 A; 200/246; 200/290; 200/302.1

[58] Field of Search ..... 200/159 A, 302, 159 R, 200/246, 290; 368/289, 290, 291, 292

[56] References Cited

U.S. PATENT DOCUMENTS 3,856,998 12/1974 Sims, Jr. ..... 200/159 R 3,950,627 4/1976 Murata et al. ..... 200/159 R 4,031,348 6/1977 Eberhardt ..... 200/302

*Primary Examiner*—Forester W. Isen

*Attorney, Agent, or Firm*—Allegretti, Newitt, Witcoff & McAndrews, Ltd.

[57] ABSTRACT

A watch comprises a push button 3 with an axis substantially perpendicular to the plane of the watch. It is slidable in a tube 2 which is fixed with respect to the bottom 1 of the casing and which is disposed in the interior of the casing. The push button 3 comprises a stem member 4 which is slideable within the tube 2 and a cap member 5 around the tube 2. A return spring 7 co-operates with the cap member 5 by way of the end which is remote from that which is fixed to the stem member 4, whereby the return spring does not require additional thickness of the casing to accommodate it.

9 Claims, 2 Drawing Figures

WATCH WITH A PUSH BUTTON

BACKGROUND OF THE INVENTION

The present invention concerns a watch comprising a control push button which is slideable in a member which is fixed with respect to the casing, the axis of the push button being substantially perpendicular to the plane of the watch, and the push button being returned to its rest position by a spring which co-operates with a component of the watch.

A push button arrangement of this nature is found in a calculator described in Swiss Pat. No. 613,802. Although the design proposed in that patent is well suited to use in a calculator, this is not the case in relation to an ultra-thin wrist watch as the proposed design requires an excessive amount of space in the direction of the thickness of the watch.

Control arrangements are also known, which comprise push buttons the axis of which is disposed in the plane of the watch. This type of arrangement is to be found in most watches of electronic type which require frequent setting operations, for example for controlling the chronograph or the alarm. However, this design is poorly suited to ultra-thin watches as it locally reduces the strength of the casing.

It should also be noted that ultra-thin watches generally have only a small number of functions, and are therefore set fairly rarely. Moreover, as the aesthetic factor with this type of article is extremely important, it is particularly advantageous for the push button to be disposed in the underside of the watch.

BRIEF SUMMARY OF THE INVENTION

The object of the present invention is to provide a watch with a push button-type control arrangement which is very well suited to an ultra-thin watch since it requires only a small amount of space in regard to height, while ensuring a good guiding operation, since it does not reduce the mechanical rigidity of the casing-,and since it also has a good sealing action.

According to the present invention, there is provided a watch comprising a casing, a re-entrant tube fixed to a wall of the casing and extending into the casing substantially perpendicular to the button thereof, a push button comprising a stem member slidably mounted in the tube and a cylindrical member fixed at one end to the inner end of the stem member and telescoping over the tube, and a return spring acting against the other end of the cylindrical member to bias the push button outwardly.

BRIEF DESCRIPTION OF THE DRAWINGS

The invention will be better appreciated from the following description which is given with reference to the accompanying figures, setting out by way of example one advantageous embodiment of this invention. In the drawings.

DETAILED DESCRIPTION OF A PREFERRED EMBODIMENT

Figure 1:
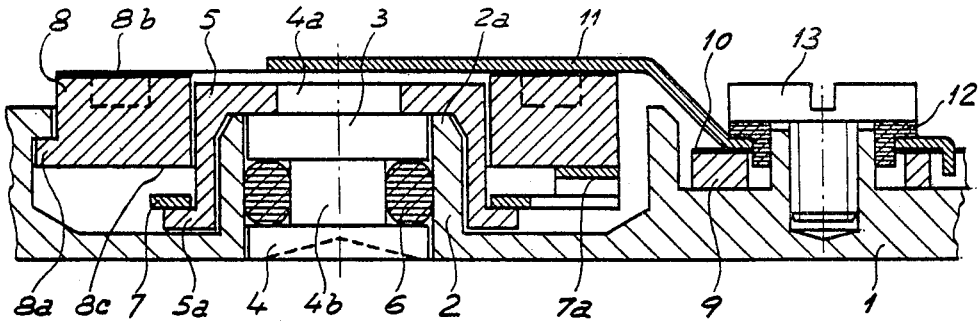
FIG. 1 is a cross-sectional view taken in vertical action on the line I—in FIG. 2, of part of a watch embodying the invention.
Figure 2:
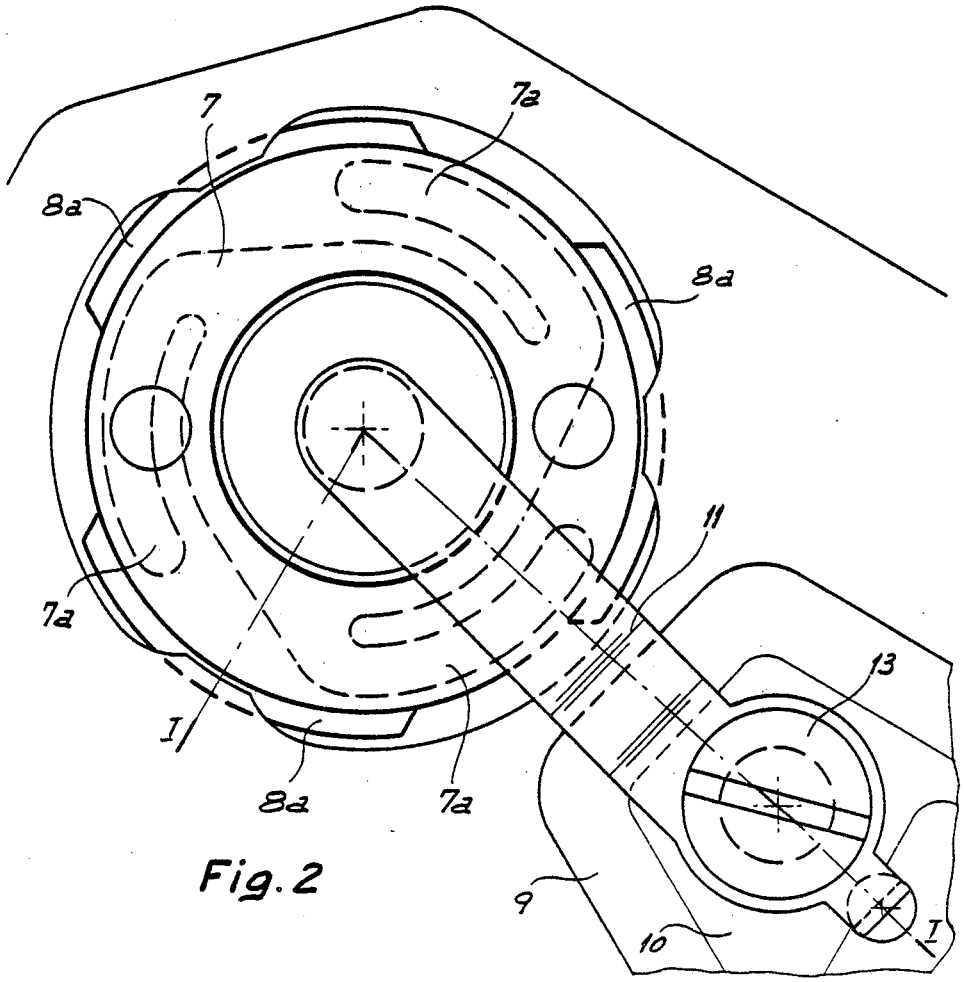
FIG. 2 is a plan view of part of the watch represented in FIG. 1.

The watch shown in FIGS. 1 and 2 comprises a casing with a bottom 1. A re-entrant cylindrical tube 2 is fixed to the bottom 1 at one of its ends and is disposed completely within the casing. A push button 3 is formed by a stem member 4 which is slidable within the tube, and cylindrical cap member 5 which is fixed to the inward end 4*a* of the member 4 and is disposed around the tube 2 over virtually the entire length thereof. The member 4 has a groove 4*b* in which there is housed a sealing ring 6, in contact with the internal wall surface of the tube 2.

The tube 2 is sufficiently long to ensure that the member 4 is properly guided therein. Advantageously, the length of the tube is at least equal to double the travel movement of the push button 3. In addition, in order to maintain the sealing action, the seal 6 is disposed in the portion of the member 4 which remains within the tube throughout the travel of the push button 3. Preferably, the part of the member 4 which is between the seal and its inward end never comes entirely out of the tube.

A return spring 7 which is in the form of a ring encompassing the cap member 5. The return spring 7 which is provided with three arm portions 7*a* acts by way of its central portion on a flange 5*a* which is provided at the end of the cap member 5 opposite to the end which is fixed to the member 4, while the three arm portions 7*a* of the return spring 7 act on a support member 8 fixed to the casing by means of lugs 8*a* on the principle of a bayonet-type connection. The support member 8 is covered by an insulating layer 8*b*.

The watch comprises a printed circuit 9 provided with conductor tracks 10. A contact blade member 11, the end of which is disposed opposite the end 4*a* of the member 4, is held against one conductor track 10 of the printed circuit by means of an insulating washer 12 and fixing screw 13.

The above described assembly makes it possible to provide an extremely thin watch, with a sealed, simple and reliable control arrangement. This is achieved by virtue of the fact that on the one hand the tube 2 is sufficiently long to permit the sealing ring 6 to be housed therein, and to ensure that the member 4 is properly guided, and on the other hand, the cap member 5 makes it posible for the return spring 7 to be positioned within the thickness of the push button 3 and not in axis alignemnt therewith. The bayonet-type assembly system also makes it possible to provide an arrangement which is east to assemble and which also enjoys easy after-sales service.

The mode of operation of the described arrangement is as follows: When the user wished to manipulate his watch, for example for setting it to the correct time, he applies pressure to the member 4 until the member comes into contact with the blade member 11. In fact, the movement of the push means 3 is stopped when the spring 7 comes into a position of abutting against the under surface 8*c* of the support member 8. Because the bottom 1 of the watch, the support member 8, the spring 7, the stem member 4 and the cap member 5 are made of conducting materials, the blade member 11 is then electrically connected to the earth of the watch. Connecting the blade member 11 to earth in that way induces a control pulse in the circuit (not shown) of the watch. When the user releases the push button again, the return spring 7 which was stressed when the push means was actuated, returns it into its rest position which is defined by the cap member 5 bearing against the free end 2A of the tube 2.

It will be appreciated that an arrangement of this kind can be used in any type of watch. It may in particular be placed on the top wall or on the bottom wall of the casing. Although, in the preferred embodiment described hereinbefore, an electrical contact arrangement is involved, it will be appreciated that the push button could also control a mechanical function. It should also be noted that the return spring may bear against a component of the watch, other than the support member 8. That component may be the printed circuit or any other fixed component of the watch.

What is claimed is:

1. In a watch of the type having a relatively wide dimension defining the plane of the watch and a relatively thin dimension substantially perpendicular to the plane of the watch, the improvement of a casing having a wall substantially parallel to the plane of the watch, a re-entrant tube fixed to said wall of the casing and extending into the casing substantially perpendicular to said wall and plane of the watch, and terminating within said casing at an inside end, a push-button comprising a stem member and a cylindrical cap member said stem member being slidably mounted in the tube and having an outer end adapted to receive contact pressure from the user of the watch, and an inner end, the distance between the outer and inner ends of the stem member defining the thickness of the stem member, said cylindrical cap member being fixed at one end to the inner end of the stem member and telescoping over said inside end of said tube, and a return spring acting against the other end of the cylindrical cap member to bias the push-button outwardly, said return spring being coaxial with and contained entirely between the outer and ends of the stem member.

2. A watch according to claim 1, wherein said wall is the bottom wall of the casing.

3. A watch according to claim 1, wherein the travel movement of the push button is less than half the length of the tube.

4. A watch according to claim 1, wherein the stem member is provided with a groove in which there is housed a sealing ring which is in contact with the internal wall surface of the tube.

5. A watch according to claim 4, wherein the part of the stem member which is disposed between the sealing ring and its inner end never comes entirely out of the tube.

6. A watch according to any of claims 2 to 5, wherein the return spring is formed by a ring provided with arm portions acting as resilient elements.

7. A watch according to claim 6, wherein the return spring encompasses the cap member.

8. A watch according to any of claim 2 to 5, wherein the return spring is retained by a support member which is fixed with respect to the casing by a bayonet-type fixing.

9. A watch according to any of claims 2 to 5, and further comprising an electrical circuit and a contact means electrically connected to the circuit, the button co-operating with the contact means when the button is pushed in.

* * * * *